United States Patent [19]

Treasarden

[11] 4,103,890

[45] Aug. 1, 1978

[54] GAME

[75] Inventor: Robert J. Treasarden, Lake Errock, Canada

[73] Assignee: The Raymond Lee Organization, Inc., New York, N.Y. ; a part interest

[21] Appl. No.: 858,692

[22] Filed: Dec. 8, 1977

[51] Int. Cl.[2] ..... A63F 9/00

[52] U.S. Cl. ..... 273/1 E; 35/25; 102/203; 273/156

[58] Field of Search ..... 273/1 E, 1 R, 156; 102/8, 70.2, 19.2; 35/25

[56] References Cited

U.S. PATENT DOCUMENTS

| | | | |
|---|---|---|---|
| 3,665,860 | 5/1972 | West | 102/70.2 R |
| 3,710,455 | 1/1973 | Liversidge et al. | 273/1 R X |
| 3,737,168 | 6/1973 | Driskill | 273/156 |
| 3,824,815 | 7/1974 | Darling | 273/156 X |
| 3,884,151 | 5/1975 | Madlener et al. | 102/19.2 |
| 3,954,262 | 5/1976 | Weber | 273/1 E |
| 4,014,111 | 3/1977 | Miller | 35/25 |

*Primary Examiner*—Paul E. Shapiro
*Attorney, Agent, or Firm*—Daniel Jay Tick

[57] ABSTRACT

An alarm plug tube of electrically insulative material in a box has electrical contacts in spaced relation. An alarm circuit in the box is electrically connected to the electrical contacts for indicating when the electrical contacts are in electrical connection. The alarm circuit has a battery, lamps and an audible alarm connected to the electrical contacts. An alarm plug of electrically insulative material has raised electrically conductive contact plates extending from the surface thereof in spaced random relation whereby a player attempts to withdraw the alarm plug from the alarm plug tube without electrically connecting the electrical contacts of the alarm plug tube via the contact plates of the alarm plug. A timer and a switch in the box are electrically connected in circuit with the audible alarm and the battery for determining a period of time during which a player attempts to remove the alarm plug from the alarm plug tube. The switch neutralizes the timer and the audible alarm when opened.

2 Claims, 3 Drawing Figures

GAME

BACKGROUND OF THE INVENTION

The present invention relates to a game.

Games of similar type to that described herein are disclosed in U.S. Pat. Nos. 2,208,952; 3,503,609; 3,710,455; 3,810,615; 3,954,262 and 3,961,794.

Objects of the invention are to provide a game of simple structure, which is inexpensive in manufacture, and provides considerable amusement, entertainment and interest to participants and onlookers.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The game of the invention comprises a box 1 having an alarm plug tube 2 (FIGS. 1 and 2) of electrically insulative material having electrical contacts 3 and 4 (FIGS. 2 and 3) in spaced relation.

Figure 3:
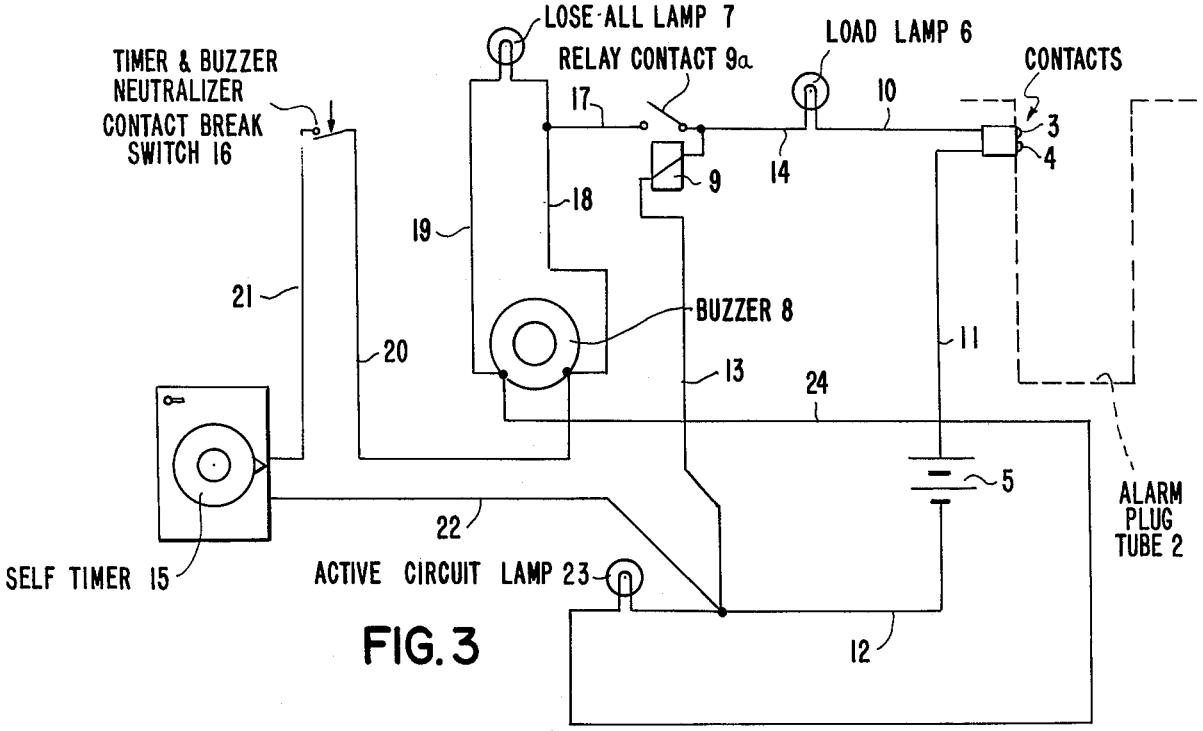
FIG. 3 is a circuit diagram of the alarm circuit and timer circuit of the game of the invention.

As shown in FIG. 3, an alarm circuit in the box 1 is electrically connected to the electrical contacts 3 and 4 for indicating when the electrical contacts are in electrical connection. The alarm circuit includes a battery 5, lamps 6 and 7 and an audible alarm or buzzer 8 connected to the electrical contacts. More particularly, the battery 5 and the load lamp 6 are connected in series circuit arrangement with a relay energizing winding 9 and the contacts 3 and 4 via electrical conductors 10, 11, 12, 13 and 14. The relay energizing winding has relay contacts 9*a* which is controlled in operation via said relay energizing winding.

The contacts 3 and 4 are also connected via the electrical conductor 12 to a self timer 15 and a switch 16 in the box 1. Thus, the contact 3 is connected via the electrical conductors 10 and 14 and the load lamp 6 and the relay contact 9*a* to the parallel connection of the lose all lamp 7 and the buzzer 8 to the series connection of the timer and buzzer neutralizer contact break switch 16 in series with the timer 15 via electrical conductors 17, 18, 19, 20 and 21. The circuit is completed by the connection of the timer 15 to the contact 4 via an electrical conductor 22, the electrical conductor 12, the battery 5 and the electrical conductor 11.

An active circuit lamp 23 is connected in circuit with the contacts 3 and 4 via the contact 3, the electrical conductor 10, the lamp 6, the electrical conductor 14, the relay contact 9*a*, the electrical conductor 17, the lamp 7, the electrical conductor 19, an electrical conductor 24, the lamp 23, the electrical conductor 12, the battery 5, the electrical conductor 11 and the contact 4.

When an electrical connection is made between the contacts 3 and 4 in the alarm plug tube 2, the relay energizing winding 9 is energized, as is the load lamp 6, to indicate such condition. When the relay energizing winding 9 is energized, it closes the relay contacts 9*a* and thereby energizes the lose all lamp 7 and the buzzer 8 to provide a visible and audible alarm.

The timer 15 is, as described, electrically connected in circuit with the switch 16, the audible alarm 8 and the battery 5, and determines a period of time, set by a player, during which a player attempts to remove an alarm plug 25 from the alarm plug tube 2, as hereinafter described. When a player operates the switch 16, by depressing same via a key type member inserted through an alarm neutralizer slot 26 formed in the box, as shown in FIG. 1, said switch neutralizes the timer 15 and the buzzer 8.

Figure 1:
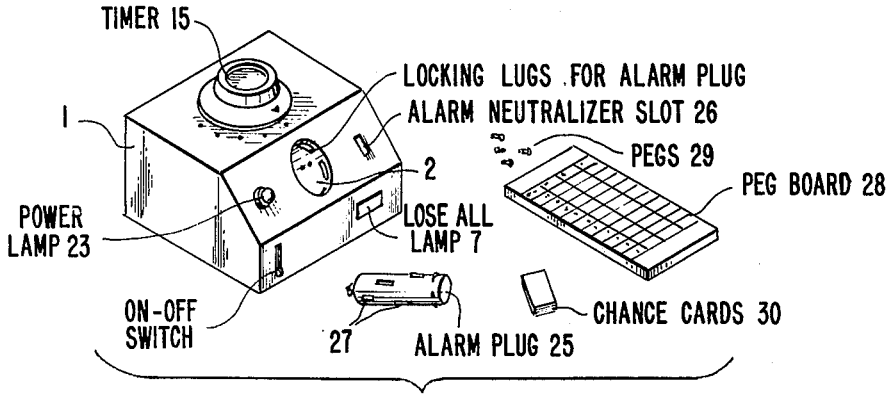
FIG. 1 is a perspective view of an embodiment of the box, the alarm plug, a plurality of pegs and the peg board of the game of the invention.
Figure 2:
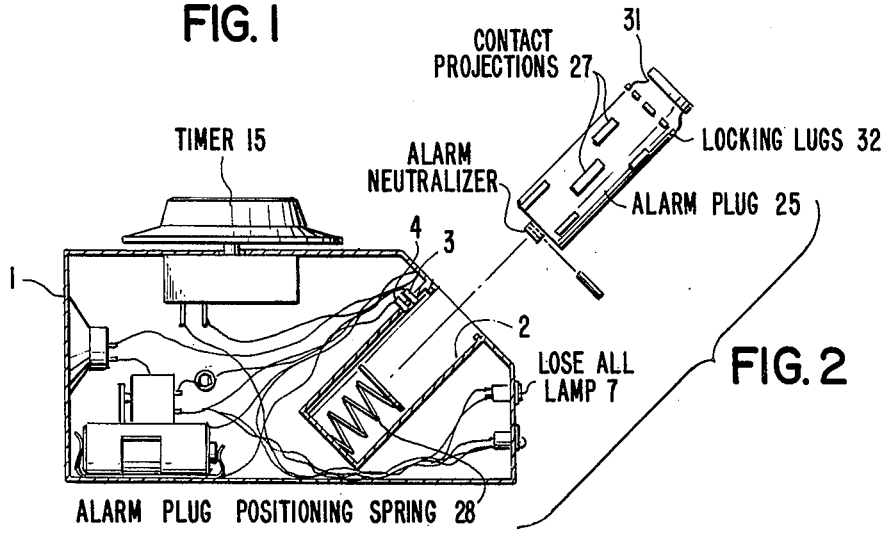
FIG. 2 is a view, on a enlarged scale, partly in section, of an embodiment of the box of the game of the invention and an embodiment of the alarm plug thereof.

The alarm plug 25 is of substantially cylindrical configuration and of electrically insulative material and has raised electrically conductive contact projections 27 extending from the surface thereof in spaced random relation, as shown in FIGS. 1 and 2. An alarm plug positioning spring 28 (FIG. 2) is provided at the bottom of the alarm plug tube 2 for positioning the alarm plug.

The object of the game is for a player to attempt to withdraw the alarm plug 25 from the alarm plug tube 2 without electrically connecting the electrical contacts 3 and 4 of said alarm plug tube via the contact projections 27 of said alarm plug. As soon as one of the contact projections 27 electrically contacts both contacts 3 and 4, the connection is made and the lamp and buzzer are energized.

A peg board 28 and pegs 29, shown in FIG. 1, are provided for keeping score and a plurality of chance cards 30 are also provided, as shown in FIG. 1. The chance cards indicate awards for players removing the alarm plug 25 from the alarm plug tube 2 without electrically connecting the electrical contacts 3 and 4 of the alarm plug tube.

The game is commenced by the selection of a player to go first.

The next player in turn sets the alarm by deenergizing the relay energizing winding 9 and closing the switch 16. The player also sets the timer 15 at a predetermined period of time such as, for example, 15 seconds. The alarm is then ready for use. The next player in turn also inserts the alarm plug 25 in the alarm plug tube 2. He then twists the alarm plug, so that it is held in position by locking lugs.

The active player switches the timer 15 ON, so that it begins to run down to zero. He or she then slightly pushes the alarm plug 25 in and then rotates the alarm plug 25 in either direction in an attempt to clear the locking lugs and attempts to remove the alarm plug. A circular indentation 31 is provided in the alarm plug 25 above the locking lugs 32, as shown in FIG. 2. The player continues to remove the alarm plug 25 until he or she has done so. The player then places a neutralizing key-type member in the alarm neutralizer slot 26 to neutralize the timer 15.

If the player succeeds in removing the alarm plug 25 from the alarm plug tube 2 without energizing the alarm 8 or 7, he or she takes a chance card. The chance card indicates how many millions of units of currency the player has won. This is recorded by the player via a peg in the appropriate peg hole of his or her peg board.

If the chance card indicates that the player loses, nothing is gained by the transaction.

If, in removing the alarm plug 25, the player actuates the alarm 8 and the lamp 7, or draws a chance card which indicates that the selector of the card has lost, such player must start again, in accordance with the directions of the card.

The first player to accumulate 12 million units of currency or more wins the game.

While the invention has been described by means of a specific example and in a specific embodiment, I do not wish to be limited thereto, for obvious modifications will occur to those skilled in the art without departing from the spirit and scope of the invention.

I claim:

1. A game, comprising a box having an alarm plug tube of electrically insulative material has electrical contacts in spaced relation;

an alarm circuit in the box electrically connected to the electrical contacts for indicating when the electrical contacts in the alarm plug tube are in electrical connection, said alarm circuit having a battery, lamps and an audible alarm connected to the electrical contacts;

an alarm plug of electrically insulative material having raised electrically conductive contact projections extending from the surface thereof in spaced random relation whereby a player attempts to withdraw the alarm plug from the alarm plug tube without electrically connecting the electrical contacts of said alarm plug tube via the contact projections of said alarm plug;

a switch in the box; and a timer in the box electrically connected in circuit with the switch, the audible alarm and the battery for determining a period of time during which a player attempts to remove the alarm plug from the alarm plug tube, said switch neutralizing the timer and the audible alarm when opened.

2. A game as claimed in claim 1, further comprising a peg board and pegs for keeping score and a plurality of chance cards indicating awards for players removing the alarm plug from the alarm plug tube without electrically connecting the electrical contacts of the alarm plug tube.

* * * * *